United States Patent [19]

Parker et al.

[11] Patent Number: 4,522,022

[45] Date of Patent: Jun. 11, 1985

[54] ROLLERS FOR FRICTION SPINNING APPARATUS

[75] Inventors: Alan Parker, Bolton; William M. Farnhill, Burnley, both of England

[73] Assignee: Hollingsworth (U.K.) Limited, England

[21] Appl. No.: 549,023

[22] Filed: Nov. 7, 1983

[30] Foreign Application Priority Data

Nov. 9, 1982 [GB] United Kingdom ..... 8231908

[51] Int. Cl.[3] ..... D01H 1/135; D01H 7/882

[52] U.S. Cl. ..... 57/401

[58] Field of Search ..... 57/400, 401, 334

[56] References Cited

U.S. PATENT DOCUMENTS 4,327,545 5/1982 Fehrer ..... 57/401 X 4,334,400 6/1982 Fehrer ..... 57/401 X 4,372,109 2/1983 Farnhill et al. ..... 57/401

*Primary Examiner*—Donald Watkins

*Attorney, Agent, or Firm*—Donald H. Feldman

[57] ABSTRACT

Friction spinning apparatus comprises two rollers arranged in parallel closely spaced relationship so as to define therebetween adjacent the line of closest approach a throat and a fibre feed means for feeding fibres into the throat for twisting into yarn as shown in G.B. No. 2042599. The surface of each of the rollers has a roughness characteristic at most 250 micro inches (6.25 microns) and the roller having its surface moving from the fibre feed means into the throat has a roughness less than that of the other roller by from 20 to 100 micro inches (0.5 to 2.54 microns).

10 Claims, No Drawings

ROLLERS FOR FRICTION SPINNING APPARATUS

This invention relates to apparatus for friction spinning and particularly to the rotatable members for such apparatus. Friction spinning apparatus comprises generally two parallel rollers arranged in closely spaced parallel relationship so as to define between them an elongate throat adjacent the line of closset approach. A fibre feed device is arranged to feed fibres into the throat so that the fibres are twisted by movement of the surfaces to form yarn which is then withdrawn along the throat and packaged. In some arrangements both of the rollers are perforated and each includes a suction duct within its interior for providing an airflow through the surface adjacent the throat. In other arrangements only one of the rollers is perforated and includes a suction duct, whereas the other roller is imperforate. In British Patent Specification No. 2042599, now assigned to Hollingsworth (UK) Ltd., there is particularly disclosed an arrangement in which on the side of the roller pair where the fibre feed duct is positioned the surface of the perforated roller moves into the throat and that of the imperforate roller moves out of the throat.

The present invention is advantageously used in conjunction with this latter apparatus, but may be used in alternative arrangements.

In British Patent Specification Nos. 1559101 and 2023196 (both in the name of Vyzkumny Ustav Bavinarsky) there are disclosed certain surfaces for the friction spinning rotatable members, including those provided by sand-blasting the surfaces and by application of various coatings. In British Patent Specification No. 2068025 (Fehrer) there is disclosed an arrangement in which the rollers have a surface characteristic such that the peak to valley height is up to one half of the diameter of the yarn being spun. The specification gives no more specific disclosures as to the details of surfaces which can be used and it will be appreciated that the range thus disclosed is a huge range incorporating many surfaces which could be totally unsatisfactory.

The present invention has as its object the provision of rotatable members which have surface characteristics which provide the best arrangement for spinning yarns, particularly when used with the apparatus disclosed in the above-mentioned specification No. 2042599.

Accordingly, the invention provides a friction spinning apparatus comprising two rotatable members arranged in closely spaced relationship so as to define therebetween adjacent the line of closest approach a throat, and a fibre feed means for feeding fibres into the throat for twisting into yarn characterised in that the surface of each of the rotatable members has a roughness characteristic in the range 40 to 250 micro inches (1 to 6.35 microns).

One embodiment of the invention will now be described in further detail. Referring to Specification No. 2042599, which disclosed an apparatus of the above general type, the apparatus is modified by providing a perforated roller and an imperforate roller each of which is formed with a hard non-resilient circumferential external surface. Such a surface may be provided by a ceramic coating on a metal base or may comprise merely the surface of the base material itself, which base material may be aluminium.

To provide the best yarn spinning characteristics, the surface of the imperforate roller which turns out of the throat relative to the feed duct, has a surface roughness of from 40 to 250 micro inches (1 to 6.35 microns) measured according to ISO Standard 1302, preferably lying in the range 50 to 250 micro inches (1.27 to 6.35 microns). One specific example of the imperforate roller has a surface roughness of 125 micro inches (3.2 microns).

The perforated roller which turns into the throat relative to the feed duct has a surface roughness characteristic less than that of the imperforate roller, and preferably less than it by from 20 to 100 micro inches (0.5 to 2.54 microns). More preferably still, the perforated roller has a roughness which is less than that of the imperforate roller by from 25 to 100 micro inches (0.635 to 2.54 microns). In the specific example referred to above, the surface roughness of the perforated roller is 50 micro inches (1.27 microns).

In another advantageous configuration the perforated roller has a surface roughness of 20 to 50 micro inches (0.5 to 1.27 microns) and the imperforate roller has a surfce roughness of 50 to 250 micro inches (1.27 to 6.35 microns).

The specified surface roughness characteristics defined above can be provided on an aluminium roller by sand-blasting with a grit of glass beads having a diameter of 0.003" (76.2 microns).

The surface characteristics of the perforated roller defined above can be provided on a steel surface by sand-blasting with the same grit.

Other surfaces may be employed, on which the specified surface roughness can be achieved by experimentation with various techniques of changing the surface characteristics which techniques are well known to those skilled in the art.

The suggested surface roughness values suggested above define ranges which will give satisfactory results with a wide range of yarn counts and fibre diameters. However, the actual values to be used in practice will be determined by reference to the yarn count, the fibre fineness, the friction characteristics of the fibres being spun and the delivery speed of the spun yarn.

It will be appreciated that although the rotatable members for effecting friction spinning in British Patent Specification No. 2,042,599 are described and illustrated as being two parallel side-by-side rollers, it is within the scope of the present invention for the rotatable members to be other forms of bodies of revolution such as skew hyperboloidal rollers or one rough roller eccentrically within a hollow cylinder whose internal surface has the appropriate roughness value.

We claim:

1. In a friction spinning apparatus comprising first and second rotatable members arranged in closely spaced relationship so as to define therebetween adjacent the line of closest approach a throat, and a fibre feed means for feeding fibres into the throat for twisting into yarn, the fibre feed means opening at one side of said line of closest approach at which said first rotatable member has its surface moving into said throat and the second rotatable member has its surface moving out of the throat;

the improvement wherein:

the surface of each of the rotatable members has a roughness characteristic of from 40 to 250 micro inches.

2. Apparatus according to claim 1, wherein the surface roughness characteristic of at least one of the rotatable members lies in the range 50 to 250 micro inches.

3. Apparatus according to claim 1, wherein the surface roughness of the rotatable member which moves into the throat is less than that of the rotatable member which moves out of the throat.

4. Apparatus according to claim 1, wherein the first rotatable member has a perforated surface having a surface roughness of 50 micro inches and the surface of the second rotatable member is imperforate and has a surface roughness of 125 micro inches.

5. Apparatus according to claim 1, wherein the rotatable members have had their surface roughness imparted by blasting with an abrasive grit.

6. Apparatus according to claim 1, wherein the rotatable members have had a hard surface coating applied thereto.

7. Apparatus according to claim 3, wherein the surface roughness of the first rotatable member is at most 50 micro inches and the surface roughness of the second rotatable member is at least 50 micro inches.

8. In friction spinning apparatus comprising first and second rotatable members arranged in closely spaced relationship so as to define therebetween adjacent the line of closest approach a throat, and a fibre feed means for feeding fibres into the throat for twisting into yarn, the fibre feed means opening at one side of said line of closest approach at which said first rotatable member has its surface moving into said throat and said second rotatable member has its surface moving out of said throat;

the improvement wherein:

the surface of each of the rotatable members has a roughness characteristic at most 250 micro inches and the surface roughness of said first rotatable member is less than that of said second rotatable member by from 20 to 100 micro inches.

9. Apparatus according to claim 8, wherein the rotatable members have had their surface roughness imparted by blasting with an abrasive grit.

10. Apparatus according to claim 8, wherein the rotatable members have had a hard surface coating applied thereto.

* * * * *

REEXAMINATION CERTIFICATE (1175th)

United States Patent [19] [11] B1 4,522,022

Parker et al. [45] Certificate Issued Dec. 19, 1989

[54] ROLLERS FOR FRICTION SPINNING APPARATUS

[75] Inventors: Alan Parker, Bolton; William M. Farnhill, Burnley, both of England

[73] Assignee: Hollingsworth (U.K.) Limited

Reexamination Request:
No. 90/001,760, Apr. 24, 1989

Reexamination Certificate for:

| | |
|---|---|
| Patent No.: | **4,522,022** |
| Issued: | **Jun. 11, 1985** |
| Appl. No.: | **549,023** |
| Filed: | **Nov. 7, 1983** |

[30] Foreign Application Priority Data

Nov. 9, 1982 [GB] United Kingdom ..... 8331908

[51] Int. Cl.[4] ..... D01H 1/135; D01H 7/882
[52] U.S. Cl. ..... 57/401
[58] Field of Search ..... 57/400, 401, 334

[56] References Cited

U.S. PATENT DOCUMENTS

| | | | |
|---|---|---|---|
| 4,281,507 | 8/1981 | Didek et al. | 57/401 |
| 4,327,545 | 5/1982 | Fehrer | 57/401 X |
| 4,334,400 | 6/1982 | Fehrer | 57/5 |
| 4,372,109 | 2/1983 | Farnhill et al. | 57/401 |

FOREIGN PATENT DOCUMENTS

| | | |
|---|---|---|
| 364290 | 10/1981 | Austria . |
| 2068025 | 8/1981 | United Kingdom . |
| 2075071 | 11/1981 | United Kingdom . |

*Primary Examiner*—Donald Watkins

[57] ABSTRACT

Friction spinning apparatus comprises two rollers arranged in parallel closely spaced relationship so as to define therebetween adjacent the line of closest approach a throat and a fibre feed means for feeding fibres into the throat for twisting into yarn as shown in G.B. No. 2042599. The surface of each of the rollers has a roughness characteristic at most 250 micro inches (6.25 microns) and the roller having its surface moving from the fibre feed means into the throat has a roughness less than that of the other roller by from 20 to 100 micro inches (0.5 to 2.54 microns).

REEXAMINATION CERTIFICATE ISSUED UNDER 35 U.S.C. 307

THE PATENT IS HEREBY AMENDED AS INDICATED BELOW.

Matter printed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDEMENT ARE PRINTED HEREIN.

Column 1, lines 46–54:

Accordingly, the invention provides a friction spinning apparatus comprising two rotatable members arranged in closely spaced relationship so as to define therebetween adjacent the line of closest approach a throat, and a fibre feed means for feeding fibres into the throat for twisting into yarn [characterised in that], the surface of each of the rotatable members [has] *having* a roughness characteristic in the range 40 to 250 micro inches (1 to 6.35 microns), *wherein the surface roughness of the rotatable member which moves into the throat is less than that of the rotatable member which moves out of the throat by from 20 to 100 micro inches.*

Column 2, lines 10–19:

The perforated roller which turns into the throat relative to the feed duct has a surface roughness characteristic less than that of the imperforate roller[, and preferably less than it] by from 20 to 100 micro inches (0.5 to 2.54 microns). [More preferably still,] *Preferably,* the perforated roller has a roughness which is less than that of the imperforate roller by from 25 to 100 micro inches (0.635 to 2.54 microns). In the specific example referred to above, the surface roughness of the perforated roller is 50 micro inches (1.27 microns).

AS A RESULT OF REEXAMINATION, IT HAS BEEN DETERMINED THAT:

The patentability of claims 8, 9 and 10 is confirmed.

Claim 1 is determined to be patentable as amended.

Claims 2, 3, 4, 5, 6 and 7, dependent on an amended claim, are determined to be patentable.

1. In a friction spinning apparatus comprising first and second rotatable members arranged in closely spaced relationship so as to define therebetween adjacent the line of closest approach a throat, and a fibre feed means for feeding fibres into the throat for twisting into yarn, the fibre feed means opening at one side of said line of closest approach at which said first rotatable member has its surface moving into said throat and the second rotatable member [has] *having* its surface moving out of the throat;

the improvement wherein:

the surface of each of the rotatable members has a roughness characteristic of from 40 to 250 micro inches[.]; *and the roughness characteristic of one of said rotatable members is different from that of the other of said rotatable members by from 20 to 100 micro inches.*

* * * * *